US005785180A

United States Patent [19]

Dressel et al.

[11] Patent Number: 5,785,180

[45] Date of Patent: Jul. 28, 1998

[54] CHILD-RESISTANT PACKAGE

[75] Inventors: Mark W. Dressel, Lake Zurich; John M. Bitner, Aurora, both of Ill.

[73] Assignee: G. D. Searle & Co., Chicago, Ill.

[21] Appl. No.: 493,582

[22] Filed: Jun. 22, 1995

[51] Int. Cl.[6] ..... B65D 83/04

[52] U.S. Cl. ..... 206/532; 206/531; 206/539; 206/469

[58] Field of Search ..... 206/461, 469, 206/532, 531, 538, 539, 807

[56] References Cited

U.S. PATENT DOCUMENTS

| | | | |
|---|---|---|---|
| 2,012,405 | 8/1935 | Salfisberg . | |
| 3,283,885 | 11/1966 | Grunewald et al. | 206/531 |
| 3,809,220 | 5/1974 | Arcudi . | |
| 3,941,248 | 3/1976 | Moser et al. | 206/531 |
| 4,011,949 | 3/1977 | Braber et al. | 206/532 |
| 4,294,361 | 10/1981 | Margulies et al. | 206/532 |
| 4,398,634 | 8/1983 | McClosky . | |
| 4,567,986 | 2/1986 | Eastwood . | |
| 4,988,004 | 1/1991 | Intini | 206/532 |
| 5,046,618 | 9/1991 | Wood . | |
| 5,088,603 | 2/1992 | Kirkpatrick . | |
| 5,172,812 | 12/1992 | Wharton et al. | 206/531 |
| 5,310,060 | 5/1994 | Bitner . | |
| 5,325,968 | 7/1994 | Sowden | 206/538 |
| 5,339,960 | 8/1994 | Price | 206/531 |
| 5,360,116 | 11/1994 | Schmiletzky | 206/531 |
| 5,393,032 | 2/1995 | Cederroth | 206/532 |

OTHER PUBLICATIONS

Colored reproductions of slides entitled "Peel and Turn" and Peel/Peel which were displayed by at a meeting of the Health Care Packaging Compliance Council on May 3, 1994.

*Primary Examiner*—David T. Fidei

[57] ABSTRACT

A child-resistant package includes a nonrupturable layer, a rupturable layer attached to the nonrupturable layer, and a blister sheet attached to the rupturable layer. The blister sheet includes at least one article-receiving pocket which is covered by a portion of the rupturable layer. A portion of the nonrupturable layer is not attached to the rupturable layer to form a pull tab which extends in a first direction which does not extend toward the pocket. An article in the pocket can be accessed only by pulling the tab in the first direction and then pulling the tab in a second direction which extends toward the pocket to expose the portion of the rupturable layer which covers the pocket. The article can then be pushed through the rupturable layer.

9 Claims, 2 Drawing Sheets

CHILD-RESISTANT PACKAGE

BACKGROUND OF THE INVENTION

The present invention generally relates to novel tamper-evident, child-resistant blister packages or pouches for medicaments and non-medicaments.

It is desirable for manufacturers of products to provide tamper-evident packaging for their products which will provide a clear indication when the packaging has been subject to tampering, and which is highly resistant to opening by children, but which, at the same time, is sufficiently easy for the average unimpaired consumer to open.

One of the problems facing parents today is their responsibility of keeping medications and other dangerous and/or small articles beyond the reach of their young children. Young children do not have the ability to recognize the risk involved in consuming prescribed or over-the-counter medication and other dangerous and/or small articles. Because of this fact, there is an important need for a package from which these items are readily accessible to an adult but are not accessible to a young child.

In past years, a trend in the packaging of medication and other dangerous and/or small articles has been to provide packages which will be safe, even if found by young children. Most developments in the "child-proofing" line have been directed to the improvement in pill bottles. In this regard, safety caps have been devised which require a certain series of pushes and turns in order to open the bottle. However, there has been less development in the area of "childproofed" blister packages or pouches with which this invention is concerned.

Blister or pouch packaging has become popular in recent years, not only for medicaments in capsule, lozenge or pill form, but also for small automotive parts, household articles, and miscellaneous hardware.

Blister packages are generally made up of a first sheet, typically a clear, preformed polyvinyl chloride or polystyrene with flexible bubbles which form separate compartments for one or more pills, and a second rupturable sheet material, such as an aluminum foil or paper sheet, which has been attached to the first sheet. The second sheet is attached to the first sheet by heat-sealing, solvent welding, gluing, or otherwise. The articles contained in the package may be removed from the blister compartment by pressing on the flexible blister which, in turn, forces the tablet against the second sheet, rupturing the second sheet, and ejecting the article.

Because the contents of blister packages are generally visible, and are often brightly colored, young children are attracted to the contents of these packages, with a substantial risk of injury and/or death if they succeed in opening such packages and ingesting their contents. Accordingly, it is important to "childproof" such packages by rendering these packages too difficult to open for children too young to realize the potential hazard in doing so but, at the same time, user friendly for adult users of the various articles contained in the packages.

The tamper-evident child-resistant blister packages of the invention for medicaments and non-medicaments are structurally different from child-resistant packaging described in the art.

SUMMARY OF THE INVENTION

The invention provides a child-resistant package for medicaments and non-medicaments which is resistant to being opened by a young child because the package challenges the cognitive skills of the child. However, the package can be easily opened by the average impaired person or even by elderly or physically impaired persons. The package comprises: (a) a top layer; (b) a non-rupturable film layer attached to the inner surface of the top layer, and to a rupturable film layer; (c) a rupturable film layer attached to that side of the nonrupturable film layer which is not attached to the top layer and to a blister sheet; (d) a blister sheet attached to that side of the rupturable film layer which is not attached to the nonrupturable film layer, the blister sheet containing at least one article-receiving pocket. A portion of the top layer and non-rupturable layer are not attached to the rupturable layer to form a pull tab which extends at an angle to the direction in which the article-receiving pocket is oriented from the pull tab. A slit extends through the top layer and the non-rupturable layer between the pull tab and the edge of the package. The article in the pocket can be removed by pulling the pull tab first in the direction in which the pull tab extends and then changing the direction in which the tab is pulled so that the tab is pulled over the pocket and the rupturable layer over the pocket is exposed. The article can then be removed by pushing it through the rupturable layer. If the direction in which the tab is pulled is not changed, the slit cut will cause the tab to tear away from the package, and the package will be disabled.

BRIEF DESCRIPTION OF THE DRAWINGS

The invention will be explained in conjunction with illustrative embodiments shown in the accompanying drawing, in which.

DETAILED DESCRIPTION OF THE INVENTION

Figure 1:
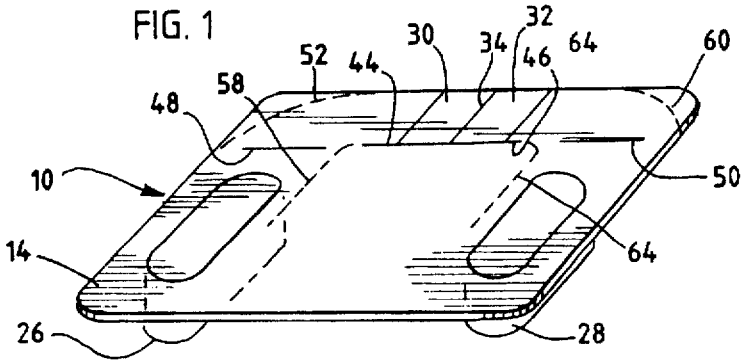
FIG. 1 is a perspective view of one embodiment of a blister package formed in accordance with the invention.
Figure 2:
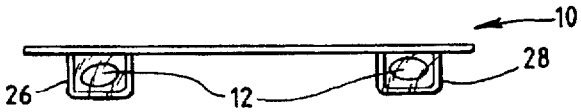
FIG. 2 is a side view of the package of FIG. 1.

The present invention relates to a novel, child-resistant blister package for medicaments and non-medicaments which is user-friendly to patients and other users of the package, but which is extremely difficult to open by young children. It is an attractive and inexpensive package for the merchandising of pharmaceutical and other products which is constructed in a manner which facilitates mass production.

The blister packages of the invention may contain from one to a multiplicity of articles, such as medicaments in the form of capsules, tablets, lozenges, pills and/or the like, or non-medicaments, such as poisons, catalysts, cleaning compositions, batteries, nuts, bolts, hooks and/or other small hardware.

The packages of the invention may be of any convenient size, and of any convenient shape, such as square, rectangular, triangular, round, or oval. The size of the package of the invention will vary, depending upon the number of article-receiving pockets which are contained therein. Preferably, the package of the invention will be of a size ranging from about 12 inches×12 inches to about 1 inch×1 inch, and more preferably about 3 inches×2 inches.

The blister packages of the invention may contain any desired number of article receiving pockets, but preferably contain from about 1 to about 100 article receiving pockets, most preferably from about 2 to about 20 article receiving pockets.

Specific packages within the scope of the invention include, but are not limited to, the packages discussed in detail herein and/or illustrated in the drawings contained herein.

Contemplated equivalents of the packages described herein and/or illustrated in the drawings contained herein include packages which otherwise correspond thereto, and which have the same general properties and/or components thereof, wherein one or more simple variations of components are made.

The novel tamper-evident, child-resistant packages described herein are believed to comply with standards of the Poison Prevention Packaging Act of 1970, 15 USC §1471–1475, and with the Act's associated regulations, 16 CFR §1700.1–1700.20, which describe test procedures in which packages are given to children for a given period of time to determine the accessibity to the children of the package contents. These standards have been promulgated by the Consumer Product Safety Commission as standards which reasonably protect children from entering packaging that would contain potentially harmful substances.

"Special Packaging" is defined by the Act and its associated regulations as being packaging that is designed or constructed to be significantly difficult for children under 51 months of age to open, or to obtain a toxic or harmful amount of the substance contained therein, within a reasonable time, and not difficult for normal adults to use properly. However, it does not mean packaging which all such children cannot open, or cannot obtain a toxic or harmful amount of a substance contained therein, within a reasonable time.

The Act and regulations require that special packaging be employed to protect children from serious personal injury or illness resulting from substances such as aspirin, acetaminophen, methyl salicylate, diphenhydramine, controlled drugs, prescription drugs, iron-containing drugs, dietary supplements containing iron, oral contraceptives, sulfuric acid, turpentine, methanol, ethylene glycol, furniture polish, kindling and/or illuminating preparations and solvents for paint and other similar surface-coating materials.

According to the Act and its associated regulations, all special packaging must meet the following specification:

(a) Child-resistant effectiveness of not less than 85 percent without a demonstration, and not less than 80 percent after a demonstration, of the proper means of opening such special packaging. In the case of unit packaging, child-resistant effectiveness of not less than 80 percent, and (b) Adult-use effectiveness of not less than 90 percent.

Two hundred (200) healthy and normal children between the ages of forty-two (42) and fifty-one (51) months of age, evenly distributed by age and sex, are required by the Act and its associated regulations to be used to test the ability of the special packaging to resist opening by children. A test failure is defined as being any child who opens the special packaging, or who gains access to its contents. In the case of unit packaging, a test failure is defined as being any child who opens, or gains access to, the number of individual units which constitute the amount that may produce serious personal injury or serious illness, or a child who opens, or gains access to, more than eight (8) individual units, whichever number is lower, during the full ten (10) minutes of the testing.

One hundred (100) adults, ages eighteen (18) to forty-five (45) years inclusive, with no overt physical or mental handicaps, and seventy (70) percent of whom are female, must comprise the test panel for normal adults.

The end result of the packages of the invention is that a young child is unlikely to open the packages successfully because, in order to open the packages, one must have knowledge of the opening procedure, rather than merely a minimum amount of strength for opening the package. A young child who is not instructed on the proper opening procedure for the packages of the invention will generally remain unable to reach the contents of the package. An older child who is able to reach the contents of the packages of the invention, on the other hand, should have sufficient understanding and discretion to avoid ingesting the contents of the package. The safety factors presented by such packaging will also tend to protect adults who are too mentally impaired (as by age, alcohol or drugs) to cope with the task of opening the packages and, at the same time, will allow unimpaired adults and even elderly and physically impaired adults to easily open the packages with a minimum amount of strength.

For the purpose of illustrating the packages of the present invention, there are shown in the drawings, which form a material part of this disclosure, two different embodiments of the packages which are presently preferred.

The various components of the packages of the invention are generally arranged in the manner shown in the drawings. However, the present invention is not limited to the precise arrangements, configurations, dimensions and instrumentalities shown in these drawings. These arrangements, configurations, dimensions and instrumentalities may be otherwise, as circumstances require.

Different specific embodiments of the packages of the present invention will now be described with reference to the drawings.

The drawings contained herein are provided to enable one of ordinary skill in the art to practice the present invention. These drawings are merely illustrative, however, and should not be read as limiting the scope of the invention as it is claimed in the appended claims:

Referring to the drawings, a tamper-evident, child-resistant blister package 10 of the invention for unit or multiple doses of pharmaceutical products or other articles 12 comprises: (1) a top layer 14; (2) an optional adhesive layer 16, or the like, underneath the top layer 14 which adheres a nonrupturable film layer 18 to the inner surface of the top layer; (3) a nonrupturable film layer 18 which is secured to the top layer 14 in the manner described above, and to a rupturable film layer 20 by methods known by those of skill in the art, such as by pressure sensitive adhesion of an optional pressure sensitive adhesive layer 19, heat seal, or the like, located between the nonrupturable film layer 18 and the rupturable film layer 20 (4) a rupturable film layer 20 located beneath the nonrupturable film layer 18; (5) an optional heat seal coating 22, adhesive layer, or the like, located underneath the rupturable film layer 20, which secures the rupturable film layer 20 to a blister sheet 24 and (6) a blister sheet 24 which contains two article-receiving pockets 26 and 28.

Figure 3:
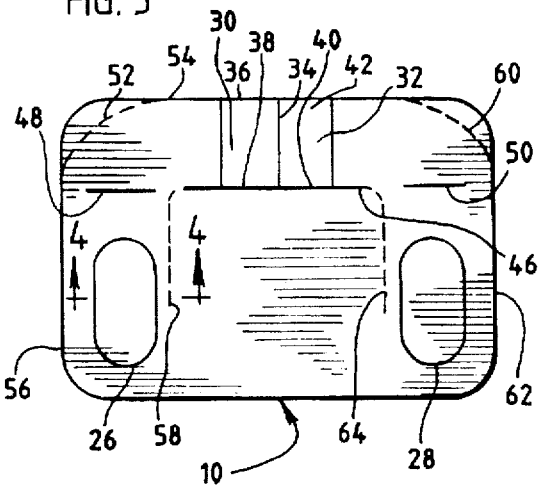
FIG. 3 is a top plan view of the package of FIG. 1.

Referring to FIG. 3, the top layer 14 and the nonrupturable layer 18 are not secured to the rupturable layer 20 in the areas 30 and 32 which are separated by a slit 34 which extends through the top layer 14 and the nonrupturable layer 18. The unsealed areas form two pull tabs. The pull tab 30 includes an end edge formed by the slit 34 and side edges 36 and 38. The pull tab 32 includes an end edge formed by the slit 34 and side edges 40 and 42.

The pull tab 30 is operable to provide access to the pocket 26, and the pull tab 32 is operable to open the pocket 28. The side edges of each tab extend in a direction away from the associated pocket so that the tab will not be pulled across the pocket if the tab is pulled in the direction of the side edges.

Die cuts or slits 44 and 46 may be formed in the top layer 14 and the nonrupturable layer 18 in line with the inner side edges 38 and 40 of the pull tabs to facilitate initiating a pulling movement in the direction of the side edges. Die cuts or slits 48 and 50 may be formed in the top layer and the nonrupturable layer in line with the slits 44 and 46 and with the side edges 38 and 40. The slits 48 and 50 are separated from the slits 44 and 46 by unslit, sealed areas wherein the top layer and the nonrupturable layer are sealed to the rupturable layer.

A curved line of perforations 52 extends across one of the corners of the package between side edges 54 and 56 of the package. A line of perforations 58 extends along the side of the pocket 26 which is opposite the side edge 56. The perforations extend through the top layer 14 and the nonrupturable layer 18.

Similarly, a curved line of perforations 60 extends between side edge 54 and side edge 62, and a line of perforations 64 extends along the side of the pocket 28 which is opposite the side edge 62.

Alternatively, a score line, slit, line of weakness or the like could be used instead of the perforations 52, 58, 60, and 64.

The pocket 26 is accessed by pulling the tab 30 in the direction of the side edges 36 and 38 to separate the nonrupturable layer 18 from the rupturable layer 20. When the area of separation reaches the perforations 52 and 58, the direction of the pulling force is turned 90° so that the edges of the tab will separate from the rupturable layer along the perforations 52 and 58. The tab is pulled until the portion of the rupturable layer 20 which covers the pocket 26 is exposed.

Figure 5:
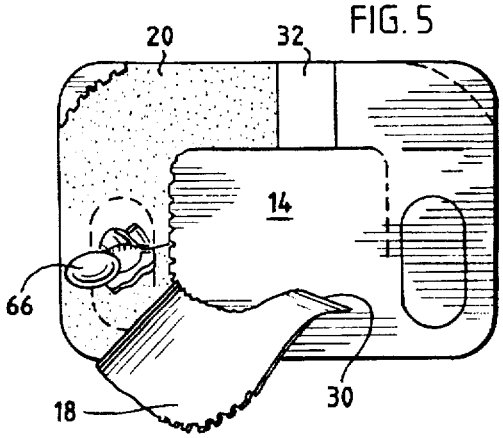
FIG. 5 illustrates the package with the pull tab removed and a pill being pushed through the rupturable layer.

As illustrated in FIG. 5, the medicament 66 or other article contained in the pocket 26 can be removed by rupturing the layer 20 over the pocket. This can easily be accomplished by exerting pressure on the bottom of the blister sheet 24 which forms the pocket to push the medicament through the rupturable layer.

If the direction of the pulling force on the pull tab is not changed, the tab will be pulled along the slit 48 toward the side edge 56 of the package, and the tab will be torn away from the package. Since the nonrupturable layer is sealed to the rupturable layer along the slit 48, after the tab has been removed, there will be no convenient way to remove the nonrupturable layer from the area above the pocket. The package is thereby disarmed and is resistant to being opened by a child or an impaired adult.

The child-resistant package is designed to challenge the cognitive skills of a child. The cognitive strategy not only delays and possibly prevents the child from gaining access to the contents short of scissors but also promotes disarming the package, thereby destroying the capability of ever opening the package. However, the cognitive strategy does not prevent an adult from opening the package. Since the child-resistant features do not rely on manual dexterity or strength, even elderly and physically impaired persons are able to open the package.

It is anticipated that a child or an impaired adult will not have the patience or reason to turn the pull tab while pulling it. The key is to peel in a direction which extends angularly to the slit 48, preferably at 90°, and not parallel to the slit. Even if a child or impaired adult successfully accomplishes pulling the pull tab in two different directions to expose the rupturable layer over a pocket, the rupturable layer might still serve to frustrate access to the contents of the package.

The package also provides evidence of tampering. If one of the pull tabs is removed, a supervising adult will know that the package has been handled. Cautionary steps can then be followed, for example, changing the storage location of the packages.

A void in the seal between the nonrupturable layer and the rupturable area along the outside edge of the desired pulling direction, i.e., along the curved perforations 52, may facilitate the desired change in direction of the peel.

Figure 4:
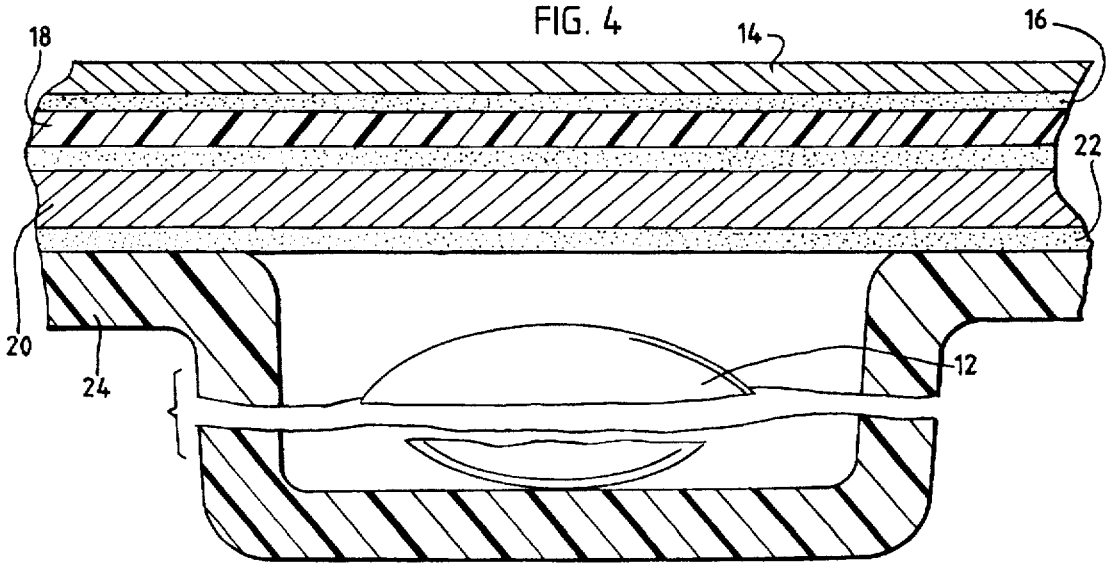
FIG. 4 is a fragmentary sectional view of the package of FIG. 1.
Figure 6:
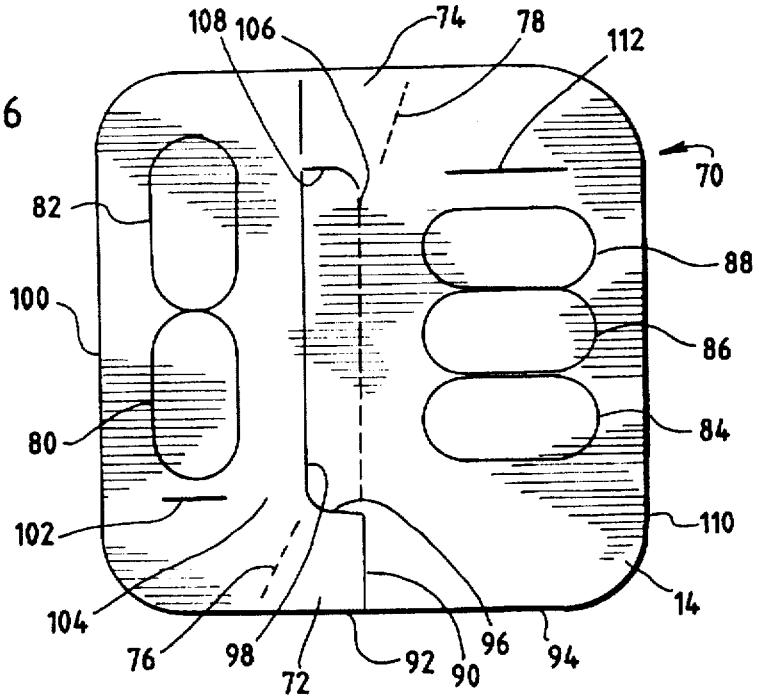
FIG. 6 is a top plan view of another embodiment of a blister package in accordance with the invention.
Figure 7:
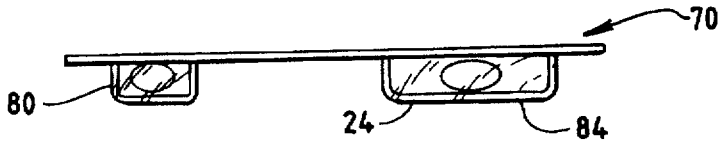
FIG. 7 is a side view of the package of FIG. 6.
Figure 8:
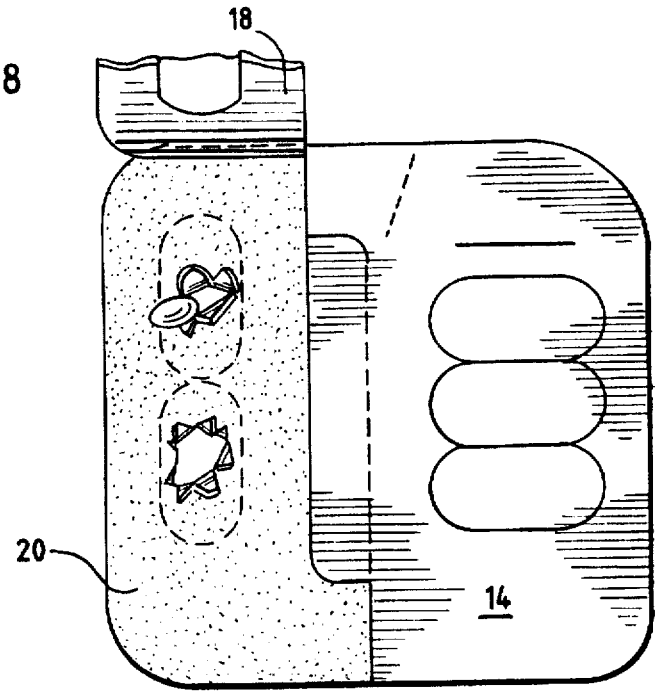
FIG. 8 illustrates the package of FIG. 6 in the process of being opened.

FIGS. 6–8 illustrate another embodiment of a child-resistant package 70. The package 70 is formed from the same materials as the package 10, namely, a top layer 14, a nonrupturable layer 18, a rupturable layer 20, and a blister sheet 24 which are secured together by adhesive or heat sealing as illustrated in FIG. 4. A pair of pull tabs 72 and 74 are provided by unsealed areas between the nonrupturable layer and the rupturable layer. The end of the unsealed areas is indicated by the dashed lines 76 and 78. The pull tab 72 is operative to provide access to the pair of pockets 80 and 82 in the blister sheet which provide, for example, a dose of two medicaments. The pull tab 74 is operative to provide access to the three pockets 84, 86, and 88 in the blister sheet, which provide a dose of three medicaments.

The pull tab 72 includes an end edge 90, a side edge 92 which is aligned with the side 94 of the package and a side edge 96 which is parallel to the side edge 94. A score line, slit, or perforation 98 in the top layer and the nonrupturable layer curves from the edge 96 of the tab and then extends parallel to the side edge 100 of the package. A slit 102 in the top layer and nonrupturable layer is aligned with the side edge 96 of the pull tab and is spaced from the score line 98 by a sealed area 104.

The pockets 80 and 82 are accessed by pulling the tab 72 first in the direction of its side edges 92 and 96 and then turning the pulling force in the direction of the score line 98 and side edge 100 so that the tab is pulled at a right angle across the slit 102. When the pull tab is pulled over the pockets, the rupturable layer above the pockets is exposed, and the articles in the pockets can be pushed through the rupturable layer as previously described.

If the direction of the pulling force on the tab is not changed, the tab will be pulled along the slit 102 and will be removed from the package, thereby disarming the pockets 80 and 82.

The pull tab 74 operates in the same way. A score line, slit, or perforation 106 in the top layer and nonrupturable layer curves from side edge 108 of the tab and extends parallel to the side edge 110 of the package. A slit 112 in the top layer and non-rupturable layer is aligned with the side edge 108 of the tab.

The pockets 84, 86, and 88 are accessed by pulling the tab 74 first in the direction of its side edges and the changing direction so that the tab is pulled across the slit 112 to expose the rupturable layer above the pockets.

An important feature of the blister package 10 of the invention is that it is designed in a manner such that one pull tab is provided for each article-receiving pocket, so that the nonrupturable film layer 18 may only be pulled directionally towards and across one article-receiving pocket at a time, while all other article-receiving pockets which may be present in the blister package remain fully secured by the undisturbed nonrupturable film layer 18. In the package 70, a separate pull tab is provided for each series of associated pockets, and other series of associated pockets remain undisturbed when one of the pull tabs is pulled.

If desired, the rupturable layer 20 of the package could be omitted, and the nonrupturable layer 18 could be attached directly to the blister sheet 24. Pulling the tab in the correct directions would then provide direct access to the pocket. Also, the top layer 14 could be omitted so that the pull tab would comprise only the nonrupturable layer 18.

While the various aspects of the blister packages of the present invention are described herein with some particularity, those of skill in the art will recognize numerous modifications and variations which remain within the spirit of the invention. These modifications and variations are within the scope of the invention as described and claimed herein.

All starting materials and equipment used to prepare the blister packages of the invention are commercially available. Generally, these starting materials were obtained from James River Corp., Milford, N.J.; Reynolds Metals Company, Richmond, Va.; Dupont, Wilmington, Del.; Morton Chemicals, Chicago, Ill.; KlocknerPentaplast of Maerica, Inc., Gordonsville, Calif.; Uhlmann Packaging Systems, Inc., Fairfield, N.J.; Aylward Enterprises, Inc., New Bern, N.C.; and Service Industries Midwest, Inc., Rolling Meadows, Ill., 60008.

All patents and publications referred to throughout the specification are hereby incorporated herein by reference, without admission that such is prior art.

Utility

The novel tamper-evident, child-resistant blister packages of the invention are useful for housing medicaments and other articles, such as small and/or dangerous articles, which should be kept beyond the reach of young children and impaired adults. These blister packages provide a clear indication when the packages have been subject to tampering, while being highly resistant to opening by young children and impaired adults but at the same time, being sufficiently easy for the average consumer to open.

Safety Features of the Blister Packages

Because of all of the steps involved in accessing a medicament or other article contained in a blister package of the invention, it is more difficult for a young child or impaired adult to gain access to the article when compared to blister-type packages described in the art. Each of the steps described hereinabove which are involved in accessing the article from the blister package of the invention makes it more difficult for a young child or impaired adult to access the article. Because of the individual steps involved for the access of each article from the blister packages of the invention, it will be much more difficult, and much more time-consuming, for a young child or impaired adult to gain access to, and swallow, multiple unit doses of medication or other articles from these packages.

Another safety feature of the blister package of the invention with respect to the access of article is that the blister package of the present invention is subdivided into separate divisions, each of which is separately openable in the manner described above, but which is not separable from the package itself. Thus, all articles must be removed from the original blister package itself. Unlike many of the blister-type packages described in the art, such as those disclosed in U.S. Pat. No. 3,921,805, in which the blister-type packages contain perforations which allow each unit or multiple dose of medication or other article contained therein to be separated from the original package into its own separate, individual package, the blister packages of the present invention do not permit such separation of the original blister package into separate, individual packages.

In addition, the blister packages of the invention have pull tabs which are designed to be pulled away from, rather than towards, other article-receiving pockets which may be present in the blister packages. Because of this fact, a child or user of the blister packages can only access one unit dose of medication or other article at a time, whether deliberately or inadvertently. For each unit dose of medication or other article to be accessed, a separate pull tab must be pulled, and the corresponding rupturable film layer which lies across that article-receiving pocket will have to be separately physically ruptured. This is another important safety feature of the blister packages of the invention. This safety feature of the blister packages of the invention also distinguishes these blister packages from the blister-type packages described in the art.

Clear evidence that the blister package of the invention has been tampered with includes each of the following four indications of tampering: (1) having one or more of the pull tabs pulled off of the package, (2) having one or more of the pull tabs pulled across one or more of the article-receiving pockets; (3) having the rupturable film layer ruptured; and/or (4) having an article missing from one or more of the article-receiving pockets.

Top Layer

The top layer 14 of the blister package of the invention is conventionally formed from a single sheet of paper, from any type of printable film, such as polyethylene, terephthalate (PET) or polyvinyl chloride (PVC), or from any other suitable material. All of these materials are commercially available. Preferably, calendared bleach paper, which is commercially available (James River Corp., Milford, N.J.), suitably punched out and perforated, adhesively coated with an adhesive layer 16 on the inner surface of the top layer (on that face of the top layer 14 which is adhered to the nonrupturable film layer 18), as with polyethylene or other suitable adhesive, and folded over to sandwich other components of the blister package, is employed.

The top layer 14 may be of any convenient basis weight. While bleached Kraft or calendared bleach paper having a basis weight of from about 20 to about 30 pounds per ream is preferred, calendared bleach paper having a basis weight of about 25 pounds per ream is most preferred.

Because, unlike many of the blister-type packages described in the art, the top layer 14 of the blister packages of the invention is not attached to a card, paper board, or other like material, the effort and expense of manufacturing these blister packages is reduced.

The size and shape of the top layer 14 will be the same size and shape of the blister package of the invention. Thus, it may be any convenient size, and any convenient shape, such as square, rectangular, triangular, round, or oval. The size of the top layer 14 will vary, depending upon the number of article-receiving pockets which are contained therein. Preferably, the top layer 14 will be of a size ranging from about 12 inches×12 inches to about 1 inch×1 inch, and more preferably about 3 inches×2 inches.

Optionally, the top layer 14 of the blister package may contain on its outer surface (the surface of the top layer 14 which will not be adhered to the nonrupturable film layer 18) printed information, such as the chemical name, dosage, strength, trademark, tradename and/or manufacturing company name for any medication contained therein, instructions to the user concerning the steps involved in accessing the medication or other article contained therein, regulatory requirements, handling conditions, precautions, such as a warning to the user to keep the blister package out of the reach of children, and/or other like information.

Adhesive Layer

The adhesive layer 16 is a layer of material which is optionally employed in the blister packages of the invention to adhere the nonrupturable film layer 18 to the top layer 14.

Examples of materials which are suitable for use as the adhesive layer 16 are known by those of skill in the art, and include polyethylene, polyester, vinyl and acrylics. All of these materials are commercially available. Preferably, a commercially-available urethane thermoset (Reynolds Metals Company, Richmond, Va.) is employed as the adhesive layer 16.

The adhesive layer 16 may be applied by methods known by those of skill in the art, such as by curtain or roller coatings, in an amount ranging from about 2.0 pounds per ream to about 1.4 pounds per ream.

Nonrupturable Film Layer

The nonrupturable film layer 18 may be adhered to the inner surface of the top layer by an adhesive layer 16 or otherwise, such as by the application of heat and/or pressure, and lies over all of the article-receiving pockets which may be present in the blister package to enclose the pockets in a manner such that they cannot be ruptured.

The purpose of the nonrupturable film layer 18 is to prevent a young child or impaired adult from accessing a medicament or other article contained in an article-receiving pocket by merely applying pressure to the article-receiving pocket. Because the nonrupturable film layer 18 is made of a material which cannot be ruptured by the application of pressure, or by biting, the user of the blister package of the invention must pull the nonrupturable film layer 18 away from the article-receiving pocket in order to obtain access to the article contained in the pocket.

The nonrupturable film layer 18 can be selected from a layer or sheet of a strong flexible material of sufficient tear strength that a pill or other article cannot be forced through the material with the application of pressure, and cannot be accessed by biting through the material. A wide variety of commercially-available plastic or other materials may be employed as the non-rupturable film layer 18. The nonrupturable film layer 18 may be made of a tough tear-resistant plastic material, such as polyethylene terephthalate, reinforced acetal resins sold commercially under the brand name Derlin, or other tough material.

A sheet of polyester material has been found to have sufficient strength to prevent a pill from being forced therethrough or otherwise accessed. A strong polyester material which has been found to be particularly effective and, thus, which is preferred as the nonrupturable film layer 18 is 48 gauge polyethylene terephthalate, which is commercially available (MYLAR®, Dupont, Wilmington, Del.). Polyethylene terephthalate is a polymeric plastic which is sold commercially under several brand names.

Among other materials which may be used as the nonrupturable film layer 18 are commercially-available polyester, polyolefin, polyamide, polycarbonate and polysulfone films, or combinations thereof. However, any material with strength sufficient to prevent a pill or other article from being hand-forced therethrough, or from being accessed by biting, can be used for this purpose. Examples of nonrupturable film layers 18 are well known in the art.

Optionally, non-plastic protective layers, such as paper or cardboard, may be employed in addition to this layer, and in addition to the rupturable film layer 20 and to the top layer 14.

The thickness of the nonrupturable film layer 18 is not critical, although it should have sufficient thickness to avoid accidental rupture. Such thickness will vary with the selection of a particular material for use as the nonrupturable film layer 18, and can readily be determined by those persons skilled in the art. Typically, the nonrupturable film layer may have a thickness in the range of from about 0.5 mm to about 4 mm, preferably from about 0.5 mm to about 1.5 mm, such as about 0.75 mm.

The nonrupturable film layer 18 will generally be of the shape and size of the blister package, but may be of any convenient shape and size, as long as it is large enough to cover any article-receiving pocket present in the blister package.

The nonrupturable film layer 18 may be co-extensive with the blister sheet 24, and may be joined to the blister sheet 24 by conventional heat-sealable coatings or otherwise.

Pressure-Sensitive Adhesive Layer

The nature of the pressure sensitive adhesive layer 19, or the like, which optionally joins the nonrupturable film layer 18 to the rupturable film layer 20 will depend upon the materials used in forming the rupturable film layer 20 and the nonrupturable film layer 18.

The pressure sensitive adhesive layer 19, in all cases, must be of such a nature that it permits the nonrupturable film layer 18 to be peeled away from the underlying rupturable film layer 20 without causing a rupture of the underlying rupturable film layer 20. Accordingly, the pressure sensitive adhesive layer 19 employed must either result in a high adherence to the nonrupturable film layer 18 and a relatively low adherence to the rupturable film layer 20, or vice versa. Typical adhesives which exhibit this quality, and which are commercially available, include rubber, vinyl, and acrylic cements.

In a preferred embodiment of the invention, where a metallic foil is employed as the rupturable film layer 20 and a polyester is employed as the nonrupturable film layer 18, an adhesive comprising rubber or acrylic cement is preferred. Thermoplastic rubber, which is commercially available from Reynolds Metals Company, Richmond, Va., is most preferred.

The pressure-sensitive adhesive layer 19 may be applied by methods known by those of skill in the art, such as by curtain or roller coating, in an amount ranging from about 0.75 pounds per ream to about 1.25 pounds per ream.

Rupturable Film Layer

The rupturable film layer 20 may be attached to the blister sheet 24 by methods known by those of skill in the art such as heat-sealing, solvent welding, gluing or otherwise adhering this layer to the blister sheet 24. This rupturable film layer 20 of the blister packages of the invention can prevent moisture and contaminants from penetrating into the article-receiving pockets.

Unlike the nonrupturable film layer 18, the rupturable film layer 20 may be ruptured by the application of pressure. Thus, once the nonrupturable film layer 18 is peeled away from the rupturable film layer 20, the medicament or other article contained in an article-receiving pocket may be accessed by the application of pressure on the article in the direction towards the rupturable film layer 20.

The rupturable film layer 20 is preferably formed from a fragile material, such as paper, selected plastics, such as cellophane, polyethylene, polypropylene, foil and other materials known by those of skill in the art, all of which are commercially available.

Because the materials described directly above are not readily heat sealable to the blister sheet 24 to form an air-tight sealed package, it is generally necessary, with such materials, to provide a layer of a heat sealable coating material 22 on the surface of the rupturable film layer 20 which faces the blister sheet 24. Such coatings are well known in the art, and may be selected from such materials as vinyls, acrylics or polyolefins, which are applied by spraying, dipping or similar techniques.

The thickness of the rupturable film layer 20 is not critical, and ordinarily will be maintained within a range which provides adequate protection for the package contents, while still being capable of rupture without the application of undue force, such as a thickness ranging from about 0.00035 inches to about 0.03 inches, preferably about 0.001 inches.

The rupturable film layer 20 is preferably a metal foil, preferably aluminum foil, which is commercially available from Reynolds Metals Company, Richmond, Va., of about 0.001 inches.

The rupturable film layer 20 may be of any convenient shape and size, but must be large enough to cover any article receiving pockets which may be present in the blister package. This layer will generally be the same size and shape as the blister package itself, and as the blister sheet 24.

Heat Seal Coatings

A heat seal coating 22 or the like is optionally employed in the blister packages 10 of the invention to secure the rupturable film layer 20 to the blister sheet 24.

Many commercially-available heat-seal coating 22 formulations are known by those of skill in the art and can optionally be used to provide heat-sealably between these two different layers of the blister packages 10 of the present invention. Such coatings may be selected from materials such as vinyls, acrylics or polyolefins, which are applied by common methods, for example, spraying, dipping, curtain coating, roller coating or similar techniques, as known in the art. These heat-seal formulations are commonly used in making foil/paper and resin sheet/resin sheet laminates for soap wraps, carton overwraps, cereal liners, cookie wraps, and other uses.

The heat-seal coating 22 formulations are typically a water dispersion of a vinyl resin or a vinyl resin containing wax for providing lower heat-sealing temperatures. The vinyl resin can be ion-linked and acid-modified ethylene interpolymers known as ionomer resins. Wax and other modifiers further extend the range of performance properties.

The preferred heat-seal coating 22 formulations for use in the present invention are water dispersions of ethylene interpolymers, for example, ethylene/vinyl acetate interpolymers. The vinyl resin formulations combine broad adhesion properties with moderate hot tack. Modifiers such as pigments, waxes or other resins can be used. The most preferred heat seal coating 22 for use in the present invention is acrylic-modified vinyl, which is commercially available from Morton Chemicals, Chicago.

The heat-seal coatings 22 may be applied by methods known by those of skill in the art, such as by curtain or roller coatings, in an amount ranging from about 2.4 pounds per ream to about 3.6 pounds per ream, preferably about 3.0 pounds per ream.

Blister Sheet

The blister sheet 24 may be a rectangular continuous blister sheet of a flexible transparent film or plastic which cannot easily be ruptured by biting or tearing or other means. Such a sheet 24 may be, for example, a vinyl thermoplastic film of about 15 mm thick.

The blister sheet 24 is made in a manner known by those of skill in the art, such as by extrusion, blown or tenter processes.

The blister sheet 24 may be square, triangular, round, oval or of any other convenient shape.

If desired, the blister sheet 24 may be made of an opaque or amber material so as to prevent light from reaching medications which deteriorate when exposed to light.

The blister sheet 24 may be of any convenient size, but preferably ranges from about 12 inches×12 inches to about 1 inch×1 inch, most preferably about 3 inches×2 inches.

Materials which may be used for the blister sheet 24 are known by those of skill in the art, are commercially available and include a variety of polymers and copolymers, such as polyvinyl chloride, nylon, polyethylene terephthalate, polyethylene, polypropylene, polystyrene and similar materials. Preferably, polyvinyl chloride of a thickness of about 15.00 mm is employed. This is commercially available from Klockner-Pentaplast, Gordonsville, Va.

The rupturable film layer 20 is sealed using conventional sealing techniques onto that surface of the blister sheet 24 which does not have article-receiving pockets 26 protruding therefrom. For example, a conventional sealant can be used to close the article-receiving pockets 26 or, preferably, a heat seal coating 22 can be used, as described in detail herein.

The blister sheet 24 has an outer surface (that surface of the blister sheet 24 which is not adhered to the rupturable film layer 20) an inner surface (that surface of the blister sheet 24 which is adhered to the rupturable film layer 20), with from one to a plurality of separate, flexible article-receiving pockets projecting from its outer surface to contain medications and/or other articles of any desired shape, and which generally conform to the size and/or shape of the particular articles to be contained within the article-receiving pockets. One or more article-receiving pockets may be cold-, thermo- or pressure formed into the blister sheet 24 by conventional forming methods known by those of skill in the art. They may be spaced apart at regular intervals and may house one or more medicaments or other articles.

In order to prevent a child or impaired adult from tearing, biting through or otherwise rupturing the blister sheet 24 and obtaining access to the contents of the blister package, the thickness of the blister sheet 24 should range from about 7.5 mm to about 30 mm, and should preferably be about 15 mm. Studies have shown that young children, who generally have sharp teeth, have bitten through blister sheets 24 having a thickness of 10 mm. In addition, it is generally not practical to have a blister sheet 24 of a thickness greater than 15 mm.

The article-receiving pockets of the blister packages of the present invention are generally filled with the desired medicaments or other articles prior to having the blister sheet 24 adhered to the other layers of the blister package 10.

Article-receiving Pockets

From one to any plurality (such as two, four, ten, twenty, thirty, forty, fifty, etc.) of article-receiving pockets are cold-, pressure- or thermal-formed into the blister sheet 24 of the blister packages 10 of the invention by conventional forming methods known by those of skill in the part.

The article-receiving pockets of the blister packages 10 of the invention are generally flexible bubbles molded into the blister sheet 24 which form separate compartments for one or more medicaments or other articles, and which project from the outer surface of the blister sheet 24 (that surface of the blister sheet 24 which is not attached to the rupturable film layer 20).

The article-receiving pockets are generally spaced from each other at regular intervals ranging from about 1/16 of an inch to about 10 inches, preferably from about 1/4 of an inch to about 3 inches, most preferably about 3/4 of an inch, but may be spaced in any other desired manner.

The article-receiving pockets may be of any convenient size. For medicaments, the pockets will generally range in size from about 1 mm×1 mm to about 50 mm×50 mm, preferably from about 1 mm×1 mm to about 10 mm×10 mm.

The article-receiving pockets may be of any desired shape generally conforming to the shape of the particular article to be contained within the article-receiving pocket, such as round, oval, triangular, square or rectangular.

Pull Tabs

A manually-grippable pull tab comprising a free portion of the top layer 14, the optional adhesive layer 16, and the nonrupturable film layer 18, is provided for each article-receiving pocket or for each series of associated pockets. The size and thickness of the pull tab is not critical, as long as the pull tab is large enough and thick enough to be manually gripped by the user of the blister package.

While the pull tab is generally of a rectangular shape, the shape of the pull tab is not critical, so long as it is of a shape which conveniently allows the user of the blister package to manually grip the pull tab.

Methods of Preparation of the Blister Packages

The blister packages of the invention may be mass produced using readily-available starting materials and conventional production procedures.

For example, the blister sheet 24 may be unwound from a roll of the material. It may then be heated and, while it is in a molten state, have article receiving pockets formed therein. The resulting formed web may then be passed through a filler, and the filler may load the medicaments or other articles into the article receiving pockets of the structure. The preferred lidding material laminate (top layer 14, adhesive layer 16, nonrupturable film layer 18, pressure sensitive adhesive layer 19, and rupturable film layer 20), which may be purchased as a preassembled laminate in accordance with the aforementioned specifications from Reynolds Metals Company, Richmond, Va., may, meanwhile, be unwinding from a second roll of material. It may then be positioned over the formed article receiving pockets. The lidding material laminate may then be heat sealed together to the blister sheet 24. The resulting structure may then travel to a perforating station where the perforations, die cuts, or slits are appropriately die cut into the top layer and nonrupturable layer by a steel rule die under pressure. The resulting structure is due cut into individual blister packages by a steel rule die under pressure.

The conditions for carrying out each of the individual steps in the production of the blister packages of the invention are conventional, well-known and capable of wide variation. For example, materials and methods other than those described herein may be used to adhere the different layers of the blister packages of the invention together. Those of skill in the art will readily understand that known variations of the conditions and processes of the preparative procedures described herein can be used to prepare the blister packages of the invention, and that other methods known in the art can also be used to produce the blister packages of the invention.

It is usually desirable to provide a paper sheet as the top layer 14 so that printing is easily read from the non-blister side of the package. However, the printed paper can be positioned next to a transparent blister sheet 24 and read through the blister sheet 24 from the top of the package.

The various layers of the blister packages of the invention other than the blister sheet 24 can be laminated to form a single laminated sheet prior to being applied to the blister sheet 24, or the layers can be secured together at the same time they are adhered to the blister sheet 24, as known by those of skill in the art.

The preferred method of laminating is by using heat-seal coatings 22, preferably a peelable heat-seal coating.

When applied as a single lamination structure, the layers of the blister package can be secured together by heat-sealing, solvent welding, gluing, applying sheets of adhesive materials between the layers, or otherwise adhering the layers together with the use of heat and/or pressure, as known by those of skill in the art. Heat-seal coatings can be used in addition to intermediate adhesive layers.

When heat-sealing is used to secure the lidding material laminate to the blister sheet 24, these two layers can be bonded by the application of heat between from about 300° to about 375° F. at about 50 kilotons (kN) of pressure from about 1 second to about 2 seconds dwell.

Although two particular embodiments of the package of the invention have been shown and described herein, those of ordinary skill in the art will recognize numerous modifications and substitutions of that which has been described herein which may be made therein, as by adding, combining, or subdividing parts or steps, or substituting equivalents, while retaining significant advantages and benefits of the package of the invention, which itself is defined in the following claims. It is intended, therefore, that all of these modifications and variations be within the scope of the present invention as described and claimed herein, and that the invention be limited only by the scope of the claims which follow, and that such claims be interpreted as broadly as is reasonable.

We claim:

1. A child-resistant package comprising:

a nonrupturable layer having top and bottom surfaces, a rupturable layer having top and bottom surfaces, the top surface thereof being attached to the bottom surface of the nonrupturable layer, a blister sheet having a top surface attached to the bottom surface of the rupturable layer, the blister sheet having at least one article-receiving pocket which is covered by a portion of the rupturable layer, a portion of the nonrupturable layer being unattached to the rupturable layer to provide a pull tab, first means to facilitate pulling the pull tab along a first path on the nonrupturable layer which does not extend toward the pocket in the blister sheet whereby pulling the pull tab along said first path will not expose the portion of the rupturable layer which covers the pocket, and second means to facilitate pulling the pull tab along a second path on the nonrupturable layer which is not aligned with said first path and which intersects said first path and which extends toward the pocket in the blister sheet whereby pulling the pull tab along the second path exposes the portion of the rupturable layer which covers the pocket, and means for permitting the pull tab to be removed from the package without exposing the portion of the rupturable layer which covers the pocket if the pull tab is pulled along said first path beyond said second path.

2. The package of claim 1 in which said first means to facilitate pulling the pull tab in said first direction comprises a pair of generally parallel side edges on the tab which extend parallel to said first direction.

3. The package of claim 1 in which said first means to facilitate pulling the pull tab in said first direction includes a slit in the nonrupturable layer which extends parallel to said first direction.

4. A child-resistant package comprising:

a nonrupturable layer having top and bottom surfaces, a rupturable layer having too and bottom surfaces, the top surface thereof being attached to the bottom surface of the nonrupturable layer, a blister sheet having a top surface attached to the bottom surface of the rupturable layer, the blister sheet having at least one article-receiving pocket which is covered by a portion of the rupturable layer, a portion of the nonrupturable layer being unattached to the rupturable layer to provide a pull tab, first means to facilitate pulling the pull tab in a first direction which does not extend toward the pocket in the blister sheet whereby pulling the pull tab in said first direction will not expose the portion of the rupturable layer which covers the pocket, and second means to facilitate pulling the pull tab in a second direction which extends toward the pocket in the blister sheet whereby pulling the pull tab in the second direction exposes the portion of the rupturable layer which covers the pocket, said first means to facilitate pulling the pull tab in said first direction comprising a pair of generally parallel side edges on the tab which extend parallel to said first direction and a slit in the nonrupturable layer which extends parallel to said first direction, said slit being spaced from said pull tab.

5. The package of claim 1 in which said first and second directions extend generally perpendicularly.

6. The package of claim 1 in which said second means to facilitate pulling the pull tab in the second direction includes perforations in the nonrupturable layer.

7. A child-resistant package comprising:

a nonrupturable layer having top and bottom surfaces, a rupturable layer having top and bottom surfaces, the top surface thereof being attached to the bottom surface of the nonrupturable layer, a blister sheet having a top surface attached to the bottom surface of the rupturable layer, the blister sheet having at least one article-receiving pocket which is covered by a portion of the rupturable layer, a portion of the nonrupturable layer being unattached to the rupturable layer to provide a pull tab having side edges, first means to facilitate pulling the pull tab in a first direction which does not extend toward the pocket in the blister sheet whereby pulling the pull tab in said first direction will not expose the portion of the rupturable layer which covers the pocket, and second means to facilitate pulling the pull tab in a second direction which extends toward the pocket in the blister sheet whereby pulling the pull tab in the second direction exposes the portion of the rupturable layer which covers the pocket, the nonrupturable layer being provided with a slit therethrough and said second means to facilitate pulling the pull tab in the second direction being positioned between the side edges of the tab and said slit.

8. The package of claim 1 in which said second means to facilitate pulling the pull tab in the second direction includes a curved line of perforations and the nonrupturable layer which curves from said first direction to said second direction.

9. A child-resistant package comprising:

a nonrupturable layer having top and bottom surfaces, a blister sheet having a top surface attached to the bottom surface of the nonrupturable layer, the blister sheet having at least one article-receiving pocket which is covered by a portion of the nonrupturable layer, a portion of the nonrupturable layer being unattached to the blister sheet to provide a pull tab having side edges, first means to facilitate pulling the pull tab in a first direction which does not extend toward the pocket in the blister sheet whereby pulling the pull tab in said predetermined direction will not expose the pocket, and second means to facilitate pulling the pull tab in a second direction which extends toward the pocket in the blister sheet whereby pulling the pull tab in the second direction exposes the pocket, the nonrupturable layer being provided with a slit therethrough and said second means to facilitate pulling the pull tab in the second direction being positioned between the side edges of the tab and said slit.

* * * * *

UNITED STATES PATENT AND TRADEMARK OFFICE

CERTIFICATE OF CORRECTION

PATENT NO. : 5,785,180

DATED : July 28, 1998

INVENTOR(S) : Mark Dressel et al

It is certified that error appears in the above-indentified patent and that said Letters Patent is hereby corrected as shown below:

Col. 15, line 31 change "too" to --top--.

Signed and Sealed this

Fifteenth Day of September, 1998

Bruce Lehman

*Attest:*

BRUCE LEHMAN

*Attesting Officer*

*Commissioner of Patents and Trademarks*